United States Patent [19]

Deguchi et al.

[11] Patent Number: 5,066,960

[45] Date of Patent: Nov. 19, 1991

[54] THERMAL PRINTING HEAD

[75] Inventors: Katsuyasu Deguchi, Nara; Takatoshi Mizoguchi, Kyoto; Takayuki Taminaga, Yamatokoriyama; Akiyoshi Fujii, Nara, all of Japan

[73] Assignee: Sharp, Osaka, Japan

[21] Appl. No.: 503,974

[22] Filed: Apr. 4, 1990

[30] Foreign Application Priority Data

| | | | |
|---|---|---|---|
| Apr. 5, 1989 | [JP] | Japan | 1-86480 |
| Aug. 25, 1989 | [JP] | Japan | 1-219203 |
| Aug. 28, 1989 | [JP] | Japan | 1-222174 |

[51] Int. Cl.[5] ..... B41J 2/335

[52] U.S. Cl. ..... 346/76 PH

[58] Field of Search ..... 346/76 PH; 249/543

[56] References Cited

FOREIGN PATENT DOCUMENTS

| | | | |
|---|---|---|---|
| 0011043 | 1/1977 | Japan | 346/76 PH |
| 59-2627 | 1/1984 | Japan . | |
| 59-52073 | 12/1984 | Japan . | |
| 0181658 | 8/1986 | Japan | 346/76 PH |
| 0237663 | 10/1986 | Japan | 346/76 PH |
| 0056464 | 3/1988 | Japan | 346/76 PH |

*Primary Examiner*—Benjamin R. Fuller
*Assistant Examiner*—Huan Tran

[57] ABSTRACT

A thermal printing head includes an insulating substrate formed of a heat resisting cloth impregnated with a heat resisting resin. A plurality of heating elements of an electrically resistive material are linearly disposed on the substrate. A shield layer is interposed between the heating elements and the substrate for preventing the substrate from exerting chemical influence on the heating elements. A plurality of conduction controlling devices mounted on the substrate is included for controlling electric conduction of the heating elements corresponding to print data. A common electrode is formed on the substrate for commonly connecting an end of each of the heating elements. A discrete electrode is formed on the substrate for connecting the other end of each of the heating elements to the conduction controlling device. Finally, metal layer is interposed between the heating elements and the electrodes for connecting both of them in an ohmic contact.

11 Claims, 16 Drawing Sheets

THERMAL PRINTING HEAD

BACKGROUND OF THE INVENTION

1. Field of the Invention

The present invention relates to a thermal printing head used mainly in a thermal print recorder.

2. Description of the Prior Art

FIG. 4 shows a peripheral structure of a heat generating unit of a conventional thermal printing head. With a thin film system, a glaze layer 102 is printed on an insulating substrate 101 and annealed. Thereafter, a heat generating layer 103 is formed by sputtering. On the heat generating layer 103, layers of a common electrode 104 and a discrete electrode 105 are formed by a vapor deposition method or a sputtering method. They are then etched into a desired pattern. Thereafter, the heat generating layer 103 is etched into a desired pattern and isolated to form a heating element array. Further, a protecting film 106 is formed by a sputtering method on the same. Eventually, heat treatment is performed at 500° to 600° C. to stabilize the heat generating layer 103 and ensure an ohmic contact exists between the heating element array and the common and discrete electrodes 104, 105.

With a thick film system, the procedure is basically the same as that of the thin film system except that a printing-annealing method is substituted for the vapor deposition method or the sputtering method. In this case, however, the a minimum annealing temperature of 800° to 900° C. is required. Usually, a ceramic substrate such as alumina is used for the insulating substrate 101; a glass of a high melting point for the glaze layer 102; Ta-$SiO_2$, $RuO_2$ or the like for the heat generating layer 103; Al, Au or the like for the common and discrete electrodes 104, 105; and SiAlON, SiON, amorphous glass or the like for the protecting film 106.

Conventionally, since heating at at least 500° to 600° C. must be required in the aforementioned manufacturing process to form a heat generating unit of a thermal printing head, an expensive ceramic substrate must be used for an insulating substrate to withstand the heat. However, the ceramic substrate has poor processability. Accordingly, the formation of circuit patterns for conducting electricity to the heat generating element is limited to one major surface of the substrate. Thus, the circuit patterns are multilayered and complicated. For example, Examined Japanese Patent Publication No. 52073/1984 discloses a thermal printing head in which a thick film circuit and a thin film circuit are put one over another on the surface of a ceramic substrate. Further, Examined Japanese Patent Publication No. 2627/1984 discloses a thermal printing head in which a multilayered circuit is formed on the surface of a substrate.

Further, the poor processability of the ceramic substrate makes it difficult to integrate a drive control IC for driving a heat generating element and other electric parts into unity on a substrate having the heat generating element.

FIGS. 5 to 7 show an overall structure of the conventional thermal head. As shown in FIG. 5, the insulating substrate 101 formed with a heating element array 103*a* and a hard printed wiring board 108 (usually, a glass fiber substrate is used, and it is referred to as "PWB" hereinafter) to which a driver 107 for drive-controlling the heating element array 103*a* is affixed by die bonding are affixed to a heat radiating board 109. Thereafter wires are bonded to it so as to electrically connect the insulating substrate 101 and the PWB 108. Referring to FIG. 6, after the heating element array 103*a* is formed, the insulating substrate 101 is integrated with the driver 107 by a wire bonding method. Further, a face down bonding method or the like is pressed against a FPC 111 (flexible printed circuit) which is bonded to a reinforcing board 110, upon the heat radiating board 109 through rubber 112 so as to come into contact with each other. Thus, the insulating substrate 101 and the FPC 111 are electrically connected. Referring to FIG. 7, the insulating substrate 101 formed with the heating element array 103*a* similar to that of FIG. 6 and integrated with the driver 107 and the FPC 111 which is bonded to the reinforcing board 110, are thermally pressed to come in contact with each other by solder. Thus, they are electrically connected. In the structure of FIG. 5, with regard to those which have been evaluated as nonconforming articles as a result of an electric test, after the insulating substrate 101 and the PWB 108 are affixed to the heat radiating board 109 and wires are bonded thereto, the insulating substrate 101, the PWB 108, the driver 107 and the heat radiating board 109 are bonded all together. Hence, it is impossible to exchange some part alone and restore the integral. They must be thrown away. Thus, there is a lot of loss in cost. In the structures in FIGS. 6 and 7, the electric test can be performed at the step where the driver 107 has been mounted on the insulating substrate 101. Thus, even if it is evaluated as a nonconforming article, only the insulating substrate 101 integrated with the driver 107 may be thrown away. However, in the structure of FIG. 6, the FPC 111 and the insulating substrate 101 are pressed to come in contact with each. Therefore it is necessary to provide a structure to hold the rubber 112. In the structure of FIG. 7, it is necessary to design a step of thermally pressing the FPC 111 and a terminal portion of the insulating substrate 101 to come in contact with each other by solder. This causes increased cost.

With regard to a process of manufacturing the heat generating element, it includes many steps under the present conditions, and it is desirable to decrease the process steps.

SUMMARY OF THE INVENTION

The present invention provides a thermal printing head comprising an insulating substrate formed of a heat resisting cloth impregnated with a heat resisting resin, a plurality of heating elements of an electrically resistive material linearly disposed on the substrate. A shield layer is interposed between the heating elements and the substrate for preventing the substrate from exerting chemical influence on the heating elements. A plurality of conduction controlling devices are mounted on the substrate for controlling electric conduction of the heating elements corresponding to print data. A common electrode is formed on the substrate for commonly connecting an end of each of the heating elements. No plurality of discrete electrode are formed on the substrate for connecting the other end of each of the heating elements to the conduction controlling device. Finally a metal layer is interposed between the heating elements and the electrodes for connecting both of them in an ohmic contact.

The aforementioned insulating substrate may have heat resistivity to 300° to 400° C. The, for example, a fiberglass impregnated with epoxy or polyimide resin is used. The heating element is made of well-known material such as Ta-$SiO_2$ and $RuO_2$, and is formed on the substrate through a layer such as SiAlON, SiON or polyimide resin for protecting its underlayer from exerting chemical influences. The common and discrete electrodes are made of metal by which an ohmic contact can be easily made between them and the heating element, for example, Ni. Because of this, a heat treatment step at high temperature (500° to 600° C.) required in the conventional process becomes unnecessary. That is, in accordance with the present invention, employing a manufacturing process through which the heat generating part of the head can be formed by heating at a temperature below 300° to 400° C., the function conventionally implemented by using two kinds of substrate can be implemented by using a single insulating substrate having heat resistance to the temperature of 300° to 400° C. Thus, double-sided wiring can be easily achieved.

BRIEF DESCRIPTION OF THE DRAWINGS

FIG. 23(*b*) illustrates is a sectional view along the line C—D of FIG. 21.

DESCRIPTION OF THE PREFERRED EMBODIMENTS

Figure 1:
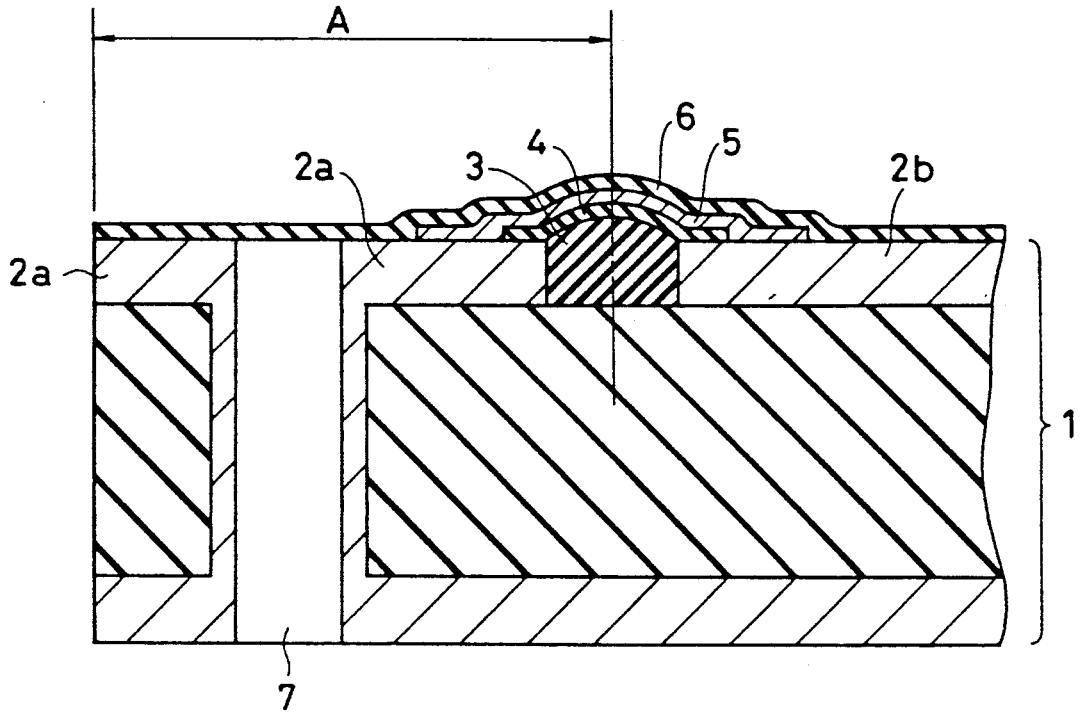
FIG. 1 is an enlarged sectional view illustrating a thermal head of an embodiment of the present invention.
Figure 4:
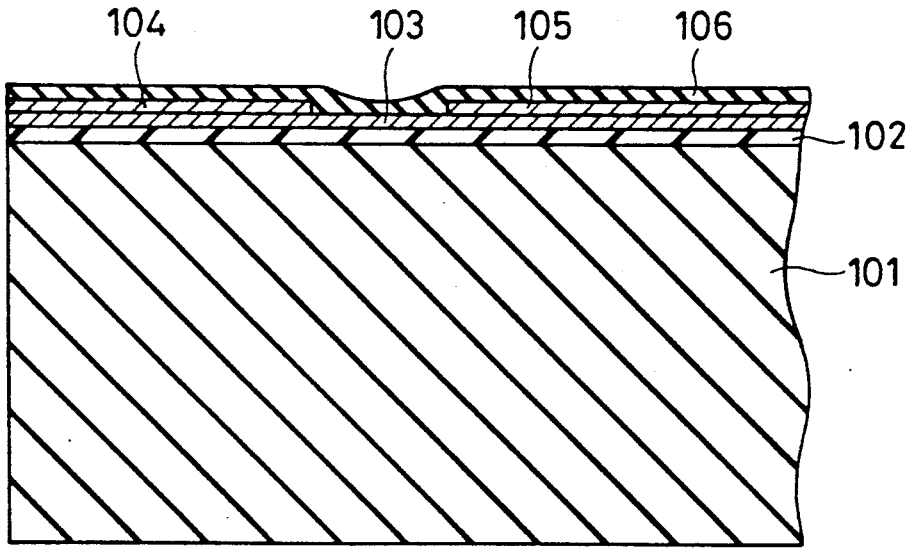
FIG. 4 (PRIOR ART)
FIG. 4 is an enlarged sectional view illustrating a prior art embodiment.
Figure 2:
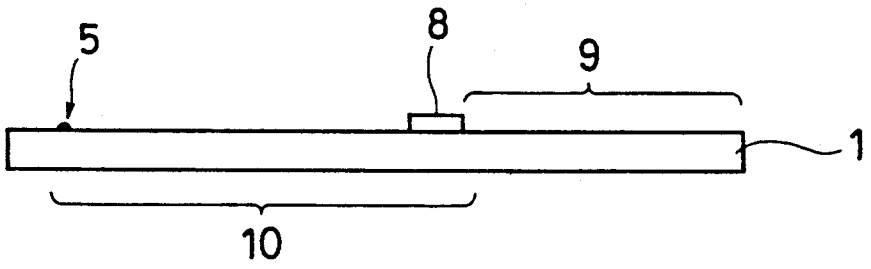
FIG. 2 is a diagram for illustrating a structure of the thermal head of the embodiment of the present invention.
Figure 3:
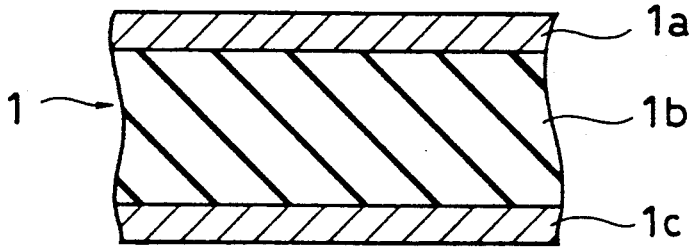
FIG. 3 is a diagram for illustrating a structure of an insulating substrate used in the thermal head in FIG. 1.

Now, embodiments of a thin film system will be described with reference to the drawings. FIGS. 1 and 2 are enlarged sectional views of a peripheral portion of a heat generating element of an embodiment of the present invention and a schematic view of a structure of a thermal head. FIG. 3 is a view for illustrating a major portion of FIG. 1. First a structure of a heat resisting insulating substrate 1 employed in this embodiment will be described with reference to FIG. 3. The heat resisting insulating substrate 1 includes a layer 1*b* made of a heat resisting cloth (e.g., a glassfiber) impregnated with a heat resisting resin (e.g., epoxy resin or polyimide resin) and two pieces of copper foil 1*a*, 1*c* put on the both sides of the layer 1*b* (a one-side board with copper foil only on one side is allowable). The insulating substrate 1 is manufactured as follows, for example: Glass fiber fabrics (made of yarn having a weight of 22 g/1000 m which is made by twisting E glass single fibers having a diameter of 7 μm together) are impregnated with trifunctional epoxy resin (VG-3101 manufactured by Mitsui Petrochemical Industries, Ltd. Japan), difunctional epoxy resin (E-1001 manufactured by Petrochemical Shell Co., Ltd. Japan) and bisphenol-type curative (VLH-129 manufactured by Petrochemical Shell Co., Ltd. Japan) so that the resin affixing amount gets to be 42% by weight. They are dried and put one over another and then molded by heating and pressurizing treatment at the temperature of 200° C. under the pressure of 30 kg/$cm^2$ for 90 minutes along with copper foil put on the top surface. A processing method similar to that of an ordinary glass fiber substrate is applicable to the substrate 1 thus manufactured.

With the processing method, a through hole can be formed to easily manufacture a double-sided wiring board. Moreover, using a heat resisting cloth and heat resisting resin, the heat resisting insulating substrate 1 has heat resistivity to a temperature above 300° to 400° C.

The peripheral structure of a heat generating part of the embodiment will be described with reference to FIG. 1. Copper foil put on the heat resisting insulating substrate 1 structured as illustrated in FIG. 3 is etched to make a desired pattern by an ordinary wiring patterning method. A common electrode 2*a* for commonly connecting one end of heating elements and a discrete electrode 2*b* for discretely drawing the other end of the heating elements, are formed simultaneously with other wiring patterns. That is, this relates to a circuit pattern from a connector (not shown) connecting external circuits to a driver (integrated circuit) 8 (FIG. 2) driving the heating elements, and so forth. Ni is plated on the copper foil pattern to ensure an ohmic contact between the pattern and a heat generating layer 5. Further, a metal, such as Au, may be plated as required.

Then, mainly in order to eliminate the level difference between the layer 1*b* and the common and discrete electrodes 2*a*, 2*b* formed by copper foil pattern, the space between both the electrodes are filled with filling material 3 (e.g., glass paste, polyimide-type varnish or the like, and more specifically, Torayneece® or Semicofine® manufactured by Toray Industries, Inc. Japan, PSI-G series manufactured by Chisso Petrochemical Co., Ltd. Japan). They which can be formed at a temperature of 300° to 400° C. or below. An insulating film 4 is formed thereon by depositing SiAlON or SiON by sputtering or plasma CVD so as to prevent the under layer of the heat generating layer 5 from exerting chemical influences. It further stabilizes the resistance value. Depending upon the kind of the filling material 3, the filling material can serve also as the insulating film.

If this is the case, the deposition of the insulating film 4 is unnecessary. Then, Ta-$SiO_2$ is deposited by sputtering to form the heat generating layer 5. Then, after a heating element array is formed by etching, SiAlON or SiON is deposited by sputtering to form a protecting film 6.

Thus, by providing the insulating film 4 (or the filling material 3) and plating the common and discrete electrodes 2a, 2b with Ni, it makes the heat treatment at high temperature (500° to 600° C.) unnecessary. Further, the maximum temperature in the heat generating element forming process is the temperature corresponding to that which the substrate 1 resists, namely 300° to 400° C. or less. In the heat resisting insulating substrate 1, a wiring patterning method similar to that of using the ordinary glass epoxy substrate can be employed. Hence, the common and discrete electrodes can be formed simultaneously with other wiring patterns. Thus, the conventional electrode forming process is unnecessary. Therefore the manufacturing process can be simplified.

Further, the common electrode 2a is connected to a pattern on the bottom face through the through hole 7. The pattern on the bottom face is used then as a part of the common electrode so as to make the current capacity larger. Thus, the distance A from the heat generating layer 5 to the edge of the substrate 1 can be made as small as possible if the through hole can be formed. Therefore, the substrate can be made small in size. By making the size of the substrate small, a larger number of substrates can be produced from a sheet of material. This leads to cost reduction.

In FIG. 2, a driver 8 is integrated on a wiring pattern formed in advance by copper foil 1a, 1c (usually, it is plated with Ni and Au on its bonding pad portions) by a wire bonding method, a face down bonding method or the like. Further, connector for connecting to other electric parts and external circuits is affixed to a part denoted by numeral 9 by solder. Thus, a thermal printing head is completed on a single substrate. A part of a circuit covering from the connector to the input terminals of the driver 8 is formed on the bottom surface 10 of the heat resisting insulating substrate 1 as shown in FIG. 2. This makes it possible for the width of parts mounting portion denotes by numeral 9 in FIG. 2 to be made smaller. In practical use, such a driver may be integrated after a head cover and a heat radiating board are attached, as required (or a part of a case of a thermal print recording device may be used, if necessary).

Although the thin film system has been described, it should be noted that this invention can be applied also to a thick film system.

Figure 8:
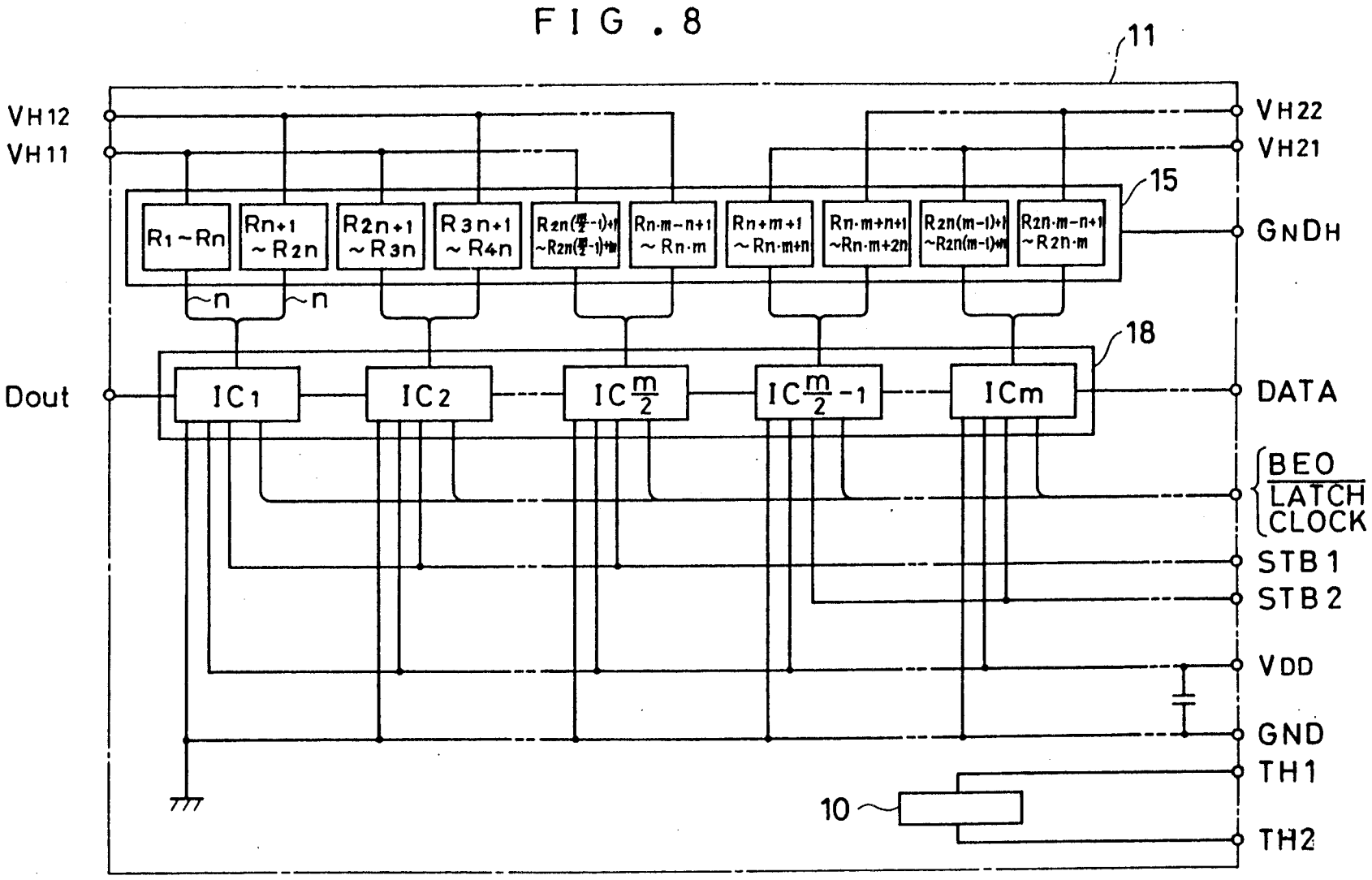
FIG. 8 is an electric circuit diagram illustrating another embodiment of the present invention.
Figure 9:
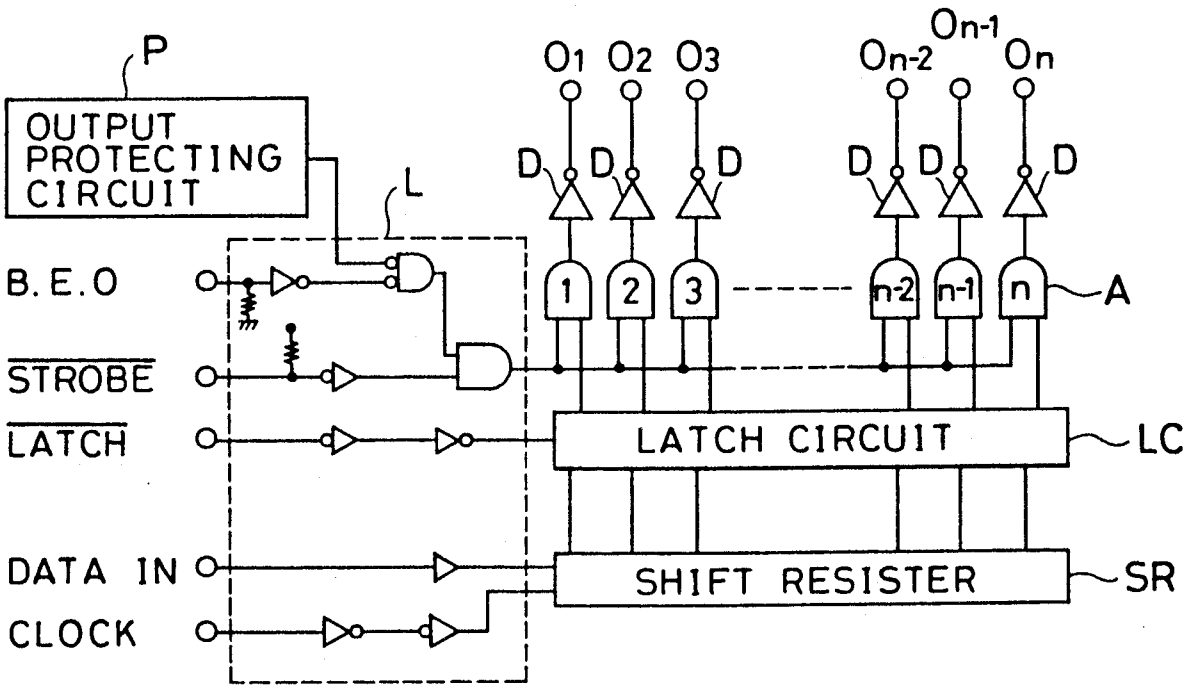
FIG. 9 is a basic circuit diagram illustrating an integrated circuit for driving in FIG. 8.
Figure 11:
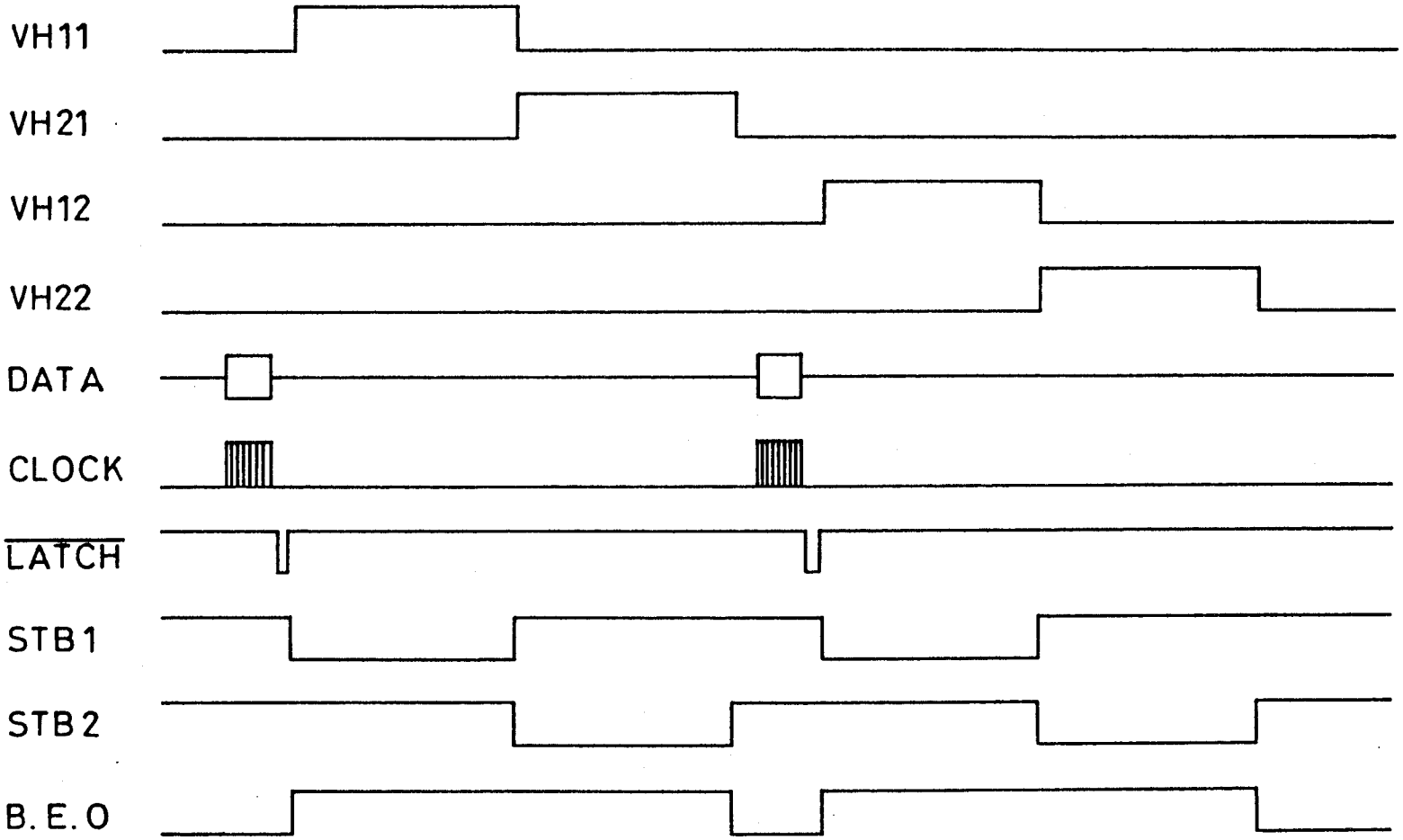
FIG. 11 is a timing chart for illustrating a divided driving system in the embodiment shown in FIG. 8.

FIG. 8 is a diagram illustrating a circuit structure of another embodiment of the present invention. Similar to the aforementioned embodiment, a heat resisting insulating substrate 11 is provided with a heating element array 15 along with a driver 18, a thermistor 10 and the like. The driver 18 is composed of m (m is an even number) driving ICs, IC1 to ICm. A basic circuit of each of the ICs, IC1 to ICm is composed, as illustrated in FIG. 9, a shift register SR, a latch circuit LC, n driving circuit elements D, n AND gates, an output protecting circuit P and a logic circuit L. Two of heating elements composing the heating element array 15 are driven by a single driving circuit element D. Further $2n \times m$ heating elements are driven by $n \times m$ driving circuit elements D. In this embodiment, although a two-divided drive is performed by driving signals STB1 and STB2, dividing the IC into a block of IC1 to ICm/2 and a block of ICm/2+1 to ICm, each of the aforementioned drive circuit elements D drives two heat generating elements with a two-divided drive method. Thus a four-divided drive method is performed in the entire thermal printing head. FIG. 11 shows a timing chart in the divided drive system.

The drive system will be explained in conjunction with FIGS. 8 and 11. Print data corresponding to the heating element R1 to Rn, R2n+1 to R3n, . . . , R2n−(m−1)+1 to R2n(m−1)+n in a first block connected to common electrodes VH11 and VH21 for power source driving the heat generating element in FIG. 8 are inputted to shift register of a driver 18 in synchronization with a CLOCK signal from a DATA terminal. Then, in response to a LATCH signal, the print data in the shift register are latched to a latch circuit in the driver 18. Thereafter, a signal B.E.O is activated to drive the drive circuit elements D. Voltage for driving the heat generating element is applied to the common electrode VH11, and a drive pulse is inputted from a terminal STB1. Thus, the heating elements R1 to Rn, R2n+1 to R3n . . . R2n in the first block connected to the ICs, IC1 to ICm/2, which are driven by a pulse signal applied to the terminal STB1, or a STB1 signal, are driven.

Then, a driving voltage is applied to the common electrode VH21, a driving pulse, or a STB2 signal, is inputted by a terminal STB2 to drive the heating elements Rn·m+1 to Rn·m+n . . . R2n(m−1)+R1 to 2n·m−n in the first block connected to the ICs, ICm/2+1 to ICm. Thus, the two-divided drive of the heating elements in the first block by the STB1 and STB2 signals is completed. Then, print data corresponding to the heating elements Rn+1 to R2n, R3n+1 to R4n, . . . R2n·m−n+1 to R2n·m in a second block connected to the common electrodes VH12 and VH22 in FIG. 1 are inputted to the shift register of the driver 18 from a DATA terminal in synchronization with a CLOCK signal. Then, in response to a LATCH signal, the print data in the shift register are latched to the latch circuit in the driver 18. After that, similar to the drive of the first block, a B.E.O signal is activated, driving voltage to the common electrode VH12 and a STB1 signal, and driving voltage to the common electrode VH22 and a STB2 signal are activated. Then, the drive voltage to the common electrode VH12 and the STB1 signal, and the driving voltage to the common electrode VH22 and the STB2 signal are deactivated to drive the heating elements in the second block.

Thus, the four-divided drive in a single line printing is completed.

Figure 12:
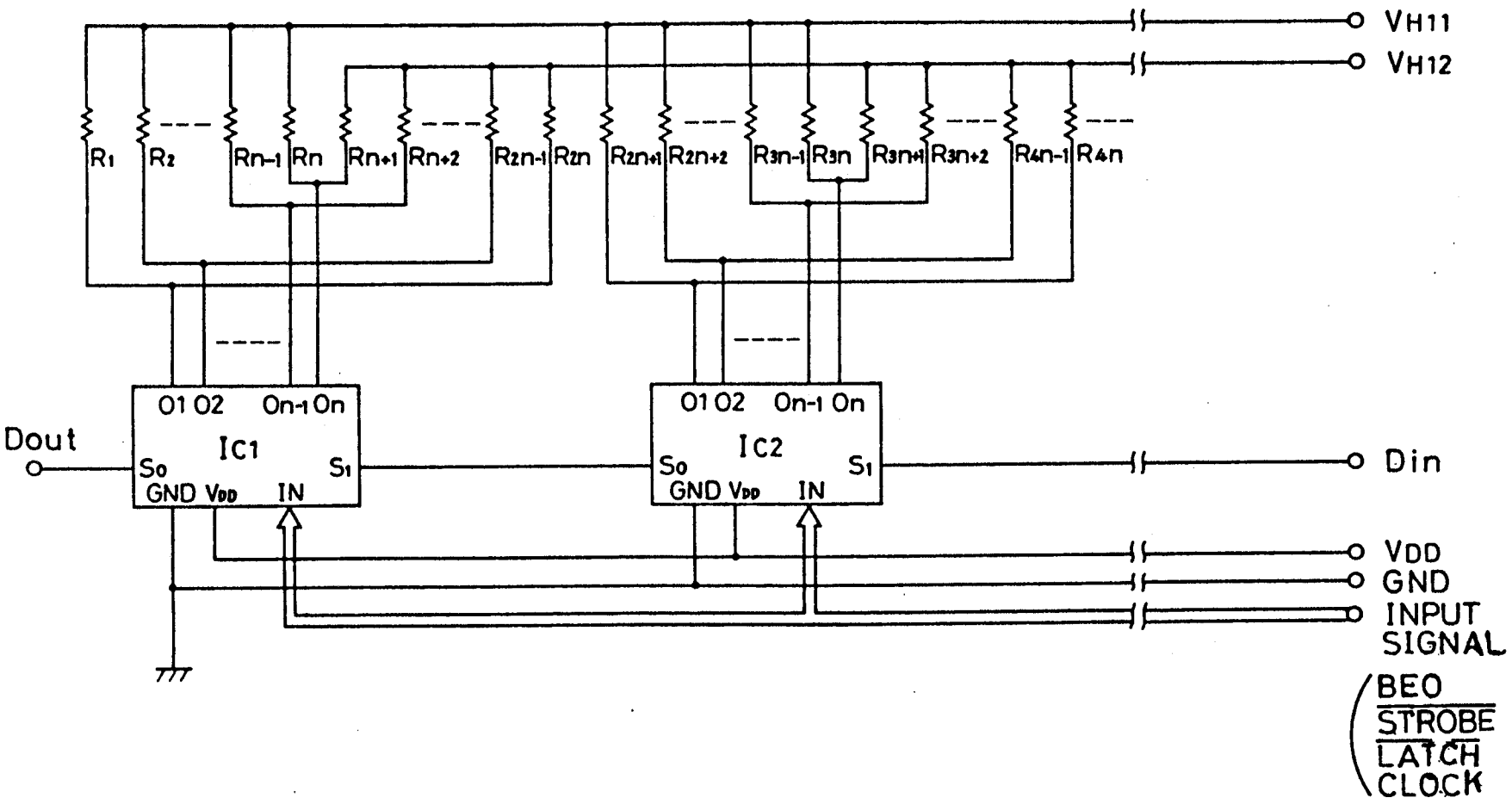
FIG. 12 is an electric circuit diagram illustrating a major portion of FIG. 8.
Figure 13:
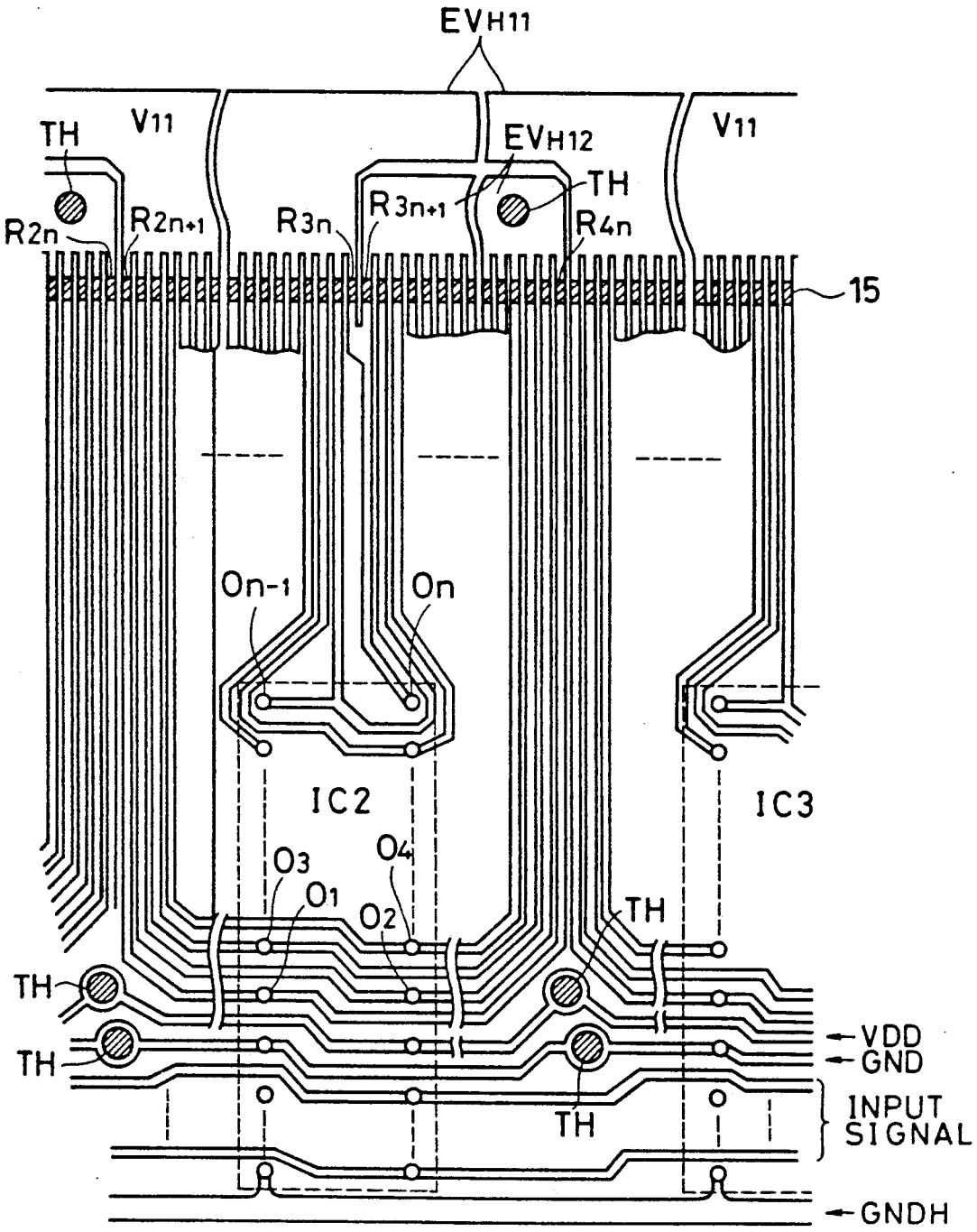
FIG. 13 is a diagram for illustrating a major portion of a wiring pattern corresponding to FIG. 8.

Then, a wiring connecting method will be described in the aforementioned drive system. FIG. 12 is a wiring diagram of the heating elements and the ICs of the driver 18. A first output $O_1$ is connected to the heating elements R1 and R2n, and output $O_2$ is connected to the heating elements R2 and R2n−1. In other words, the "i"th output Oi is connected to Ri and R2n+1−i. FIG. 13 is a diagram showing a wiring pattern connecting integrated circuit output and the heating elements around the IC2. IC1 to ICn are attached to the wiring pattern by face down bonding. The common electrodes VH11 and VH21 in the first block are wired on the surface of the substrate, while the common electrodes VH12 and VH22 in the second block are wired on the bottom surface of the substrate through a through hole TH. A single through hole TH is provided for a single integrated circuit of the driver 18.

Figure 10:
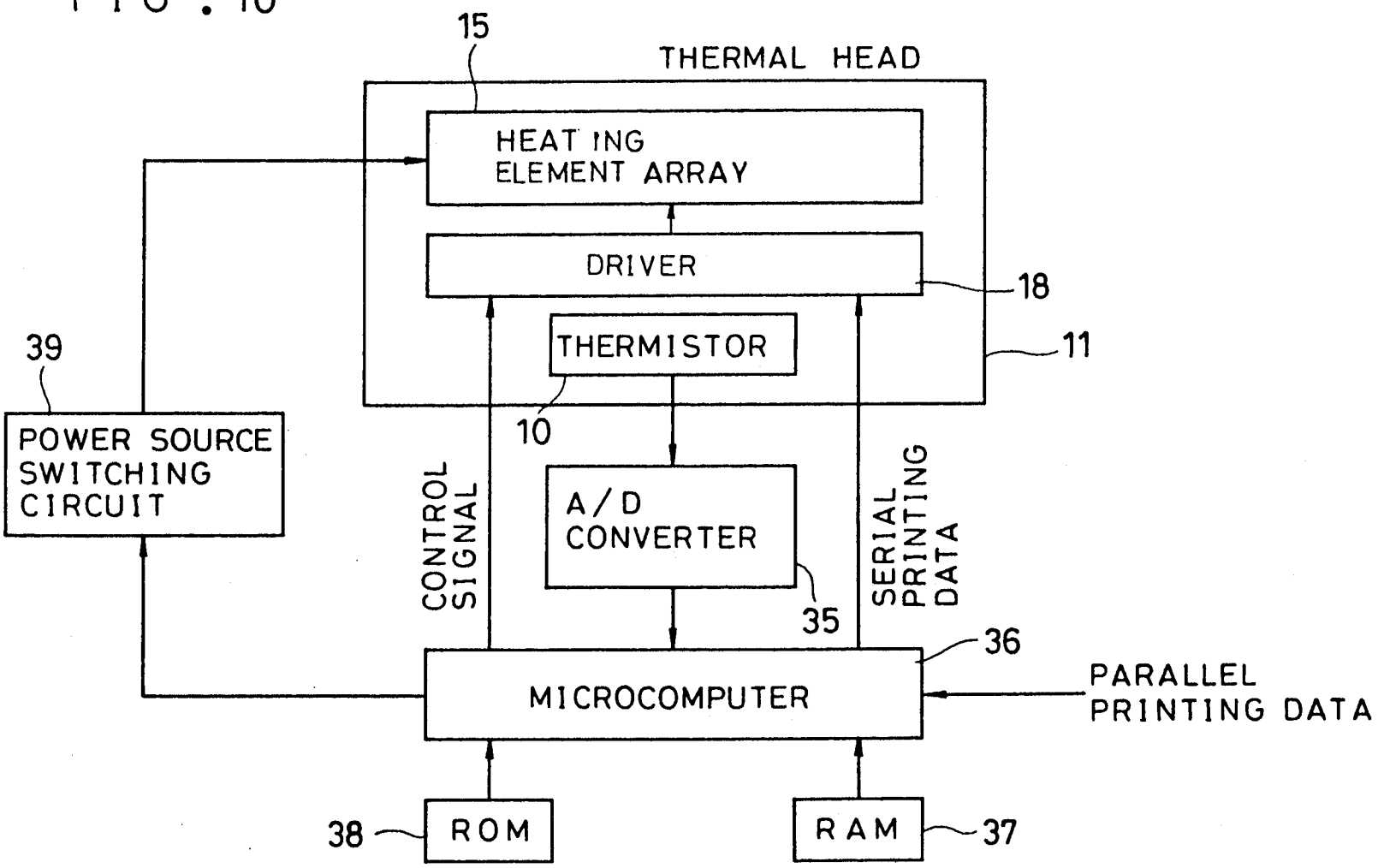
FIG. 10 is a block diagram illustrating a peripheral circuit for driving the thermal head of FIG. 8.

Subsequently, a method of inputting print data to the thermal head of this embodiment will be described. FIG. 10 shows a block diagram showing a structure of the thermal head of the embodiment and its peripheral portion. A thermistor 10 is provided in a substrate (thermal head) 1 to detect temperature, and a microcomputer 36 reads the digital data converted from an analog signal of the thermistor 3 by an A/D converter 35. It further controls a control signal to the driver 18 to correct the variation in the printing density related to temperature. The microcomputer 36 has parallel print data stored in a RAM 37, reads the print data from the RAM 37, changing a RAM address at any time in printing and converts it into serial data to input it to a drive control circuit 2.

The control operation of the microcomputer 36 in a single line printing will now be described.

Figure 14:
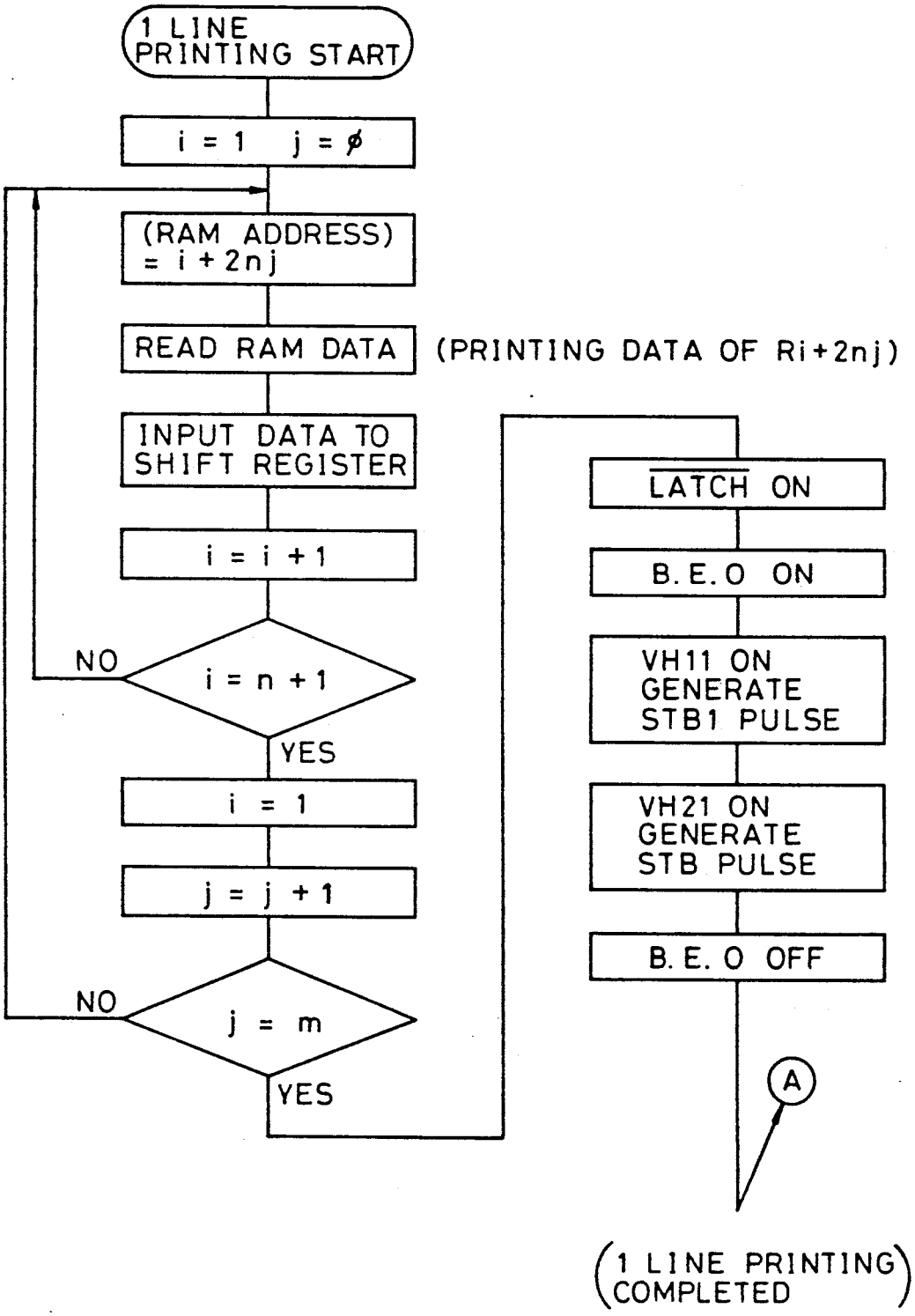
FIGS. 14(*a*) and 14(*b*) are flow charts for illustrating the operation of the electric circuit shown in FIG. 10.
Figure 14:
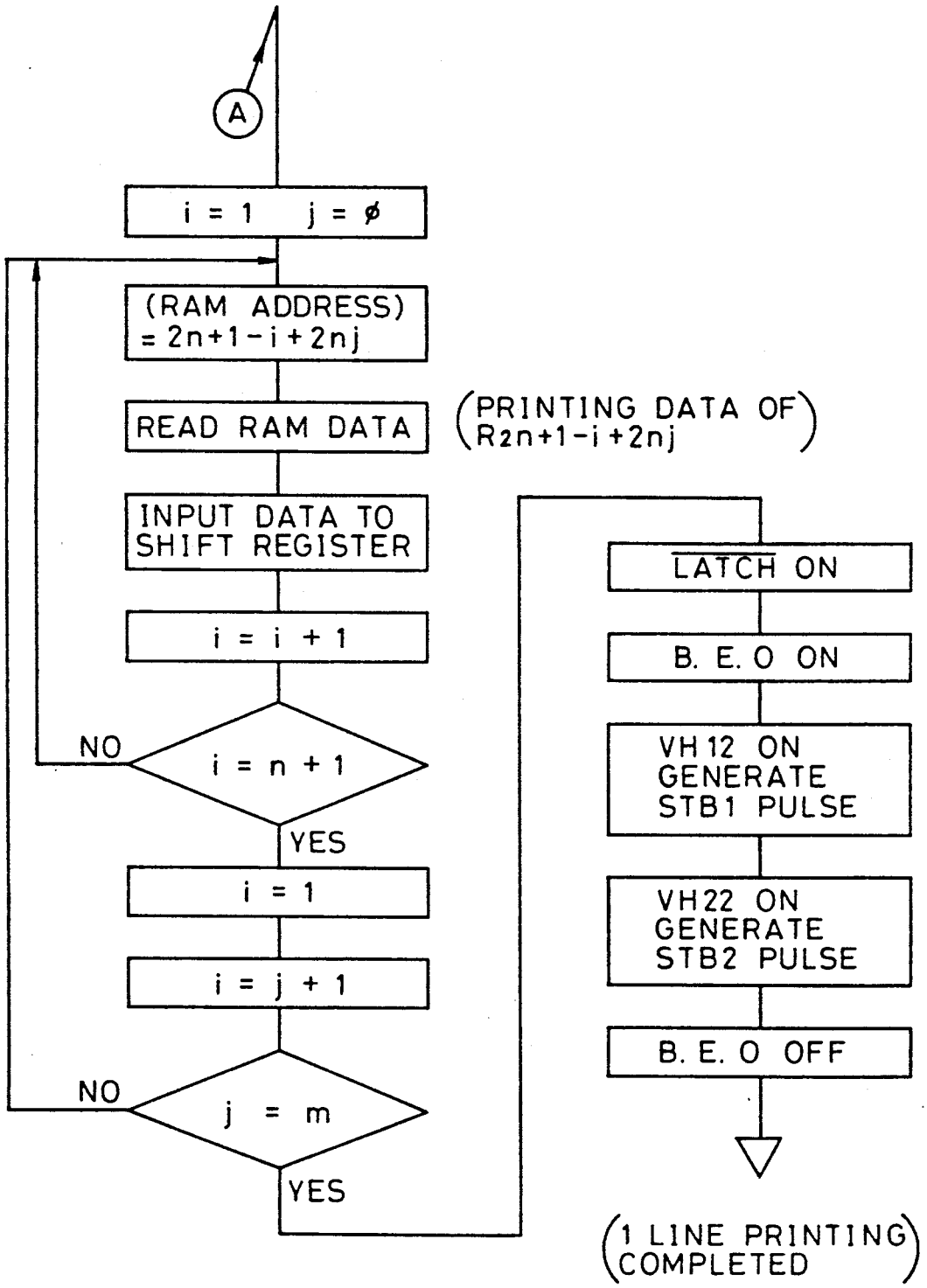

FIG. 14 is a flow chart showing the control operation of the microcomputer 36 to the thermal printing head 1 in a single line printing. First variables i, j of a loop counter are initialized, and an address related to a RAM storing the print data for the heating elements in the first block is determined. In the initial state, first the address of the RAM storing the print data for the heating element R1 is designated and the print data is read from the RAM. Then, the data is inputted to the shift register, and the address of the RAM is incremented. This procedure is repeated n times. First, the print data on the heating elements in the first block connected to the IC1 (j=0) is inputted. Then the print data on the heating elements in the first block connected to the IC2 is inputted. The procedure is repeated m times to input the print data on all the heating elements in the first block connected to the IC1 to ICm to the shift register. Then, in response to the LATCH signal, the data are latched to the latch circuit, and the B.E.O signal is activated to enable printing. Then, printing voltage for the heating elements is applied to the common electrode VH11 and simultaneously, a driving pulse is applied to the terminal STB1, so as to print with the heating elements in the first block connected to the IC1 to ICm/2 in the driver 18. Then, applied voltage is applied to the common electrode VH21. Simultaneously a driving pulse is applied by the terminal STB2 to print with the heating elements in the first block connected to the ICm/2+1 to ICm. With the deactivation of the B.E.O signal, printing a single line by the heating elements Ri+2nj (i=1 to n, j=0 to m−1) in the first block is completed. Then, the print data corresponding to the heating elements R2n+1−i+2nj (i=1 to n, j=0 to m−1) in the second block are read from the RAM as in the first block to input them to the shift register. Then, in response to the LATCH signal, they are latched to the latch circuit. The B.E.O signal is activated to apply voltage to the common electrode VH12. The STB1 pulse is generated to apply voltage to the common electrode VH22, and the STB2 pulse is generated to deactivate the B.E.O signal. Thus, printing a single line by the heating elements in the second block is completed.

The processing system carried out by a microcomputer in the four-divided drive system has been described according to the first embodiment of the present invention. The present invention is not limited to the technical range specified with regard to the embodiment in the description of the four-divided drive.

Figure 15:
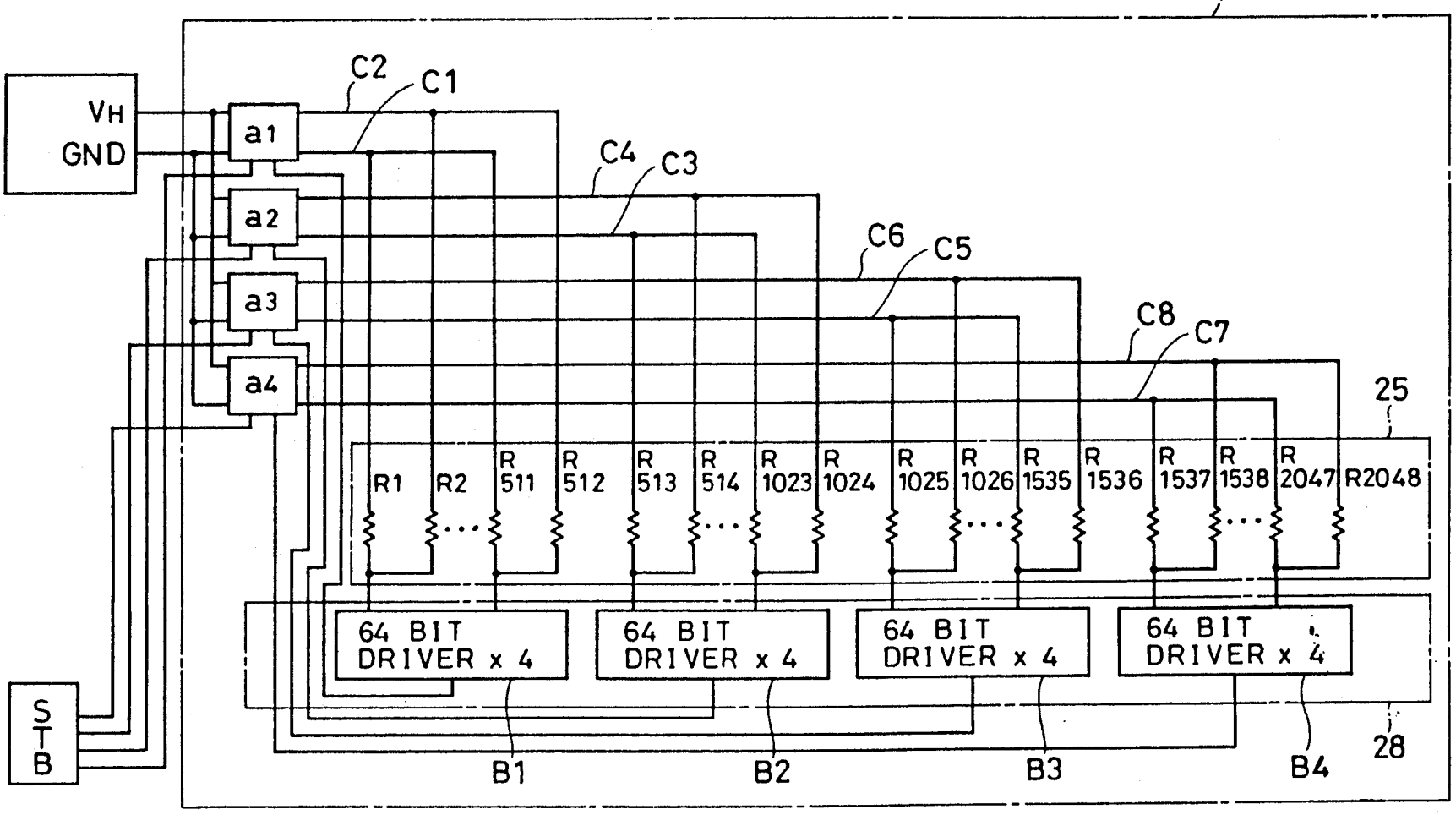
FIG. 15 is a block diagram of a circuit of a thermal head illustrating still another embodiment of the present invention.
Figure 18:
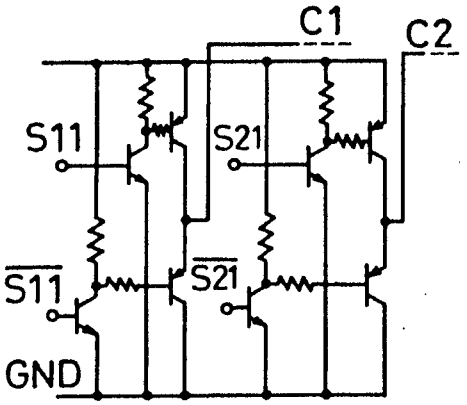
FIGS. 17 to 19 are electric circuit diagrams illustrating the major portion of FIG. 15.

FIG. 15 is a block diagram of a circuit of a thermal head of still another embodiment of the present invention. In this embodiment, similar to the aforementioned embodiment, a heat resisting insulating substrate 21 is provided with a heating element array 25 including heating elements R1 to R2048 along with the driver 28, and voltage level switching circuits a1 to a4 are mounted on the substrate 21. The block diagram is illustrated in the context of the time division printing of four-division. With regard to the heating elements R1 to R2048, driver units B1 to B4 composing the driver 28 are connected to one end of each of two heating elements. Further, the driver units are driven, time-divided into four blocks by a strobe signal (STB signal). The other end of each of the heating elements R1 to R2048 is connected to two common electrodes C1 to C8 independent in each divided block, as shown in FIG. 15. The common electrodes C1 to C8 are connected to the voltage level switching circuits a1 to a4. These circuits are composed, for example, of a block as illustrated in FIG. 17 and a push-pull circuit as illustrated in FIG. 18.

Figure 16:
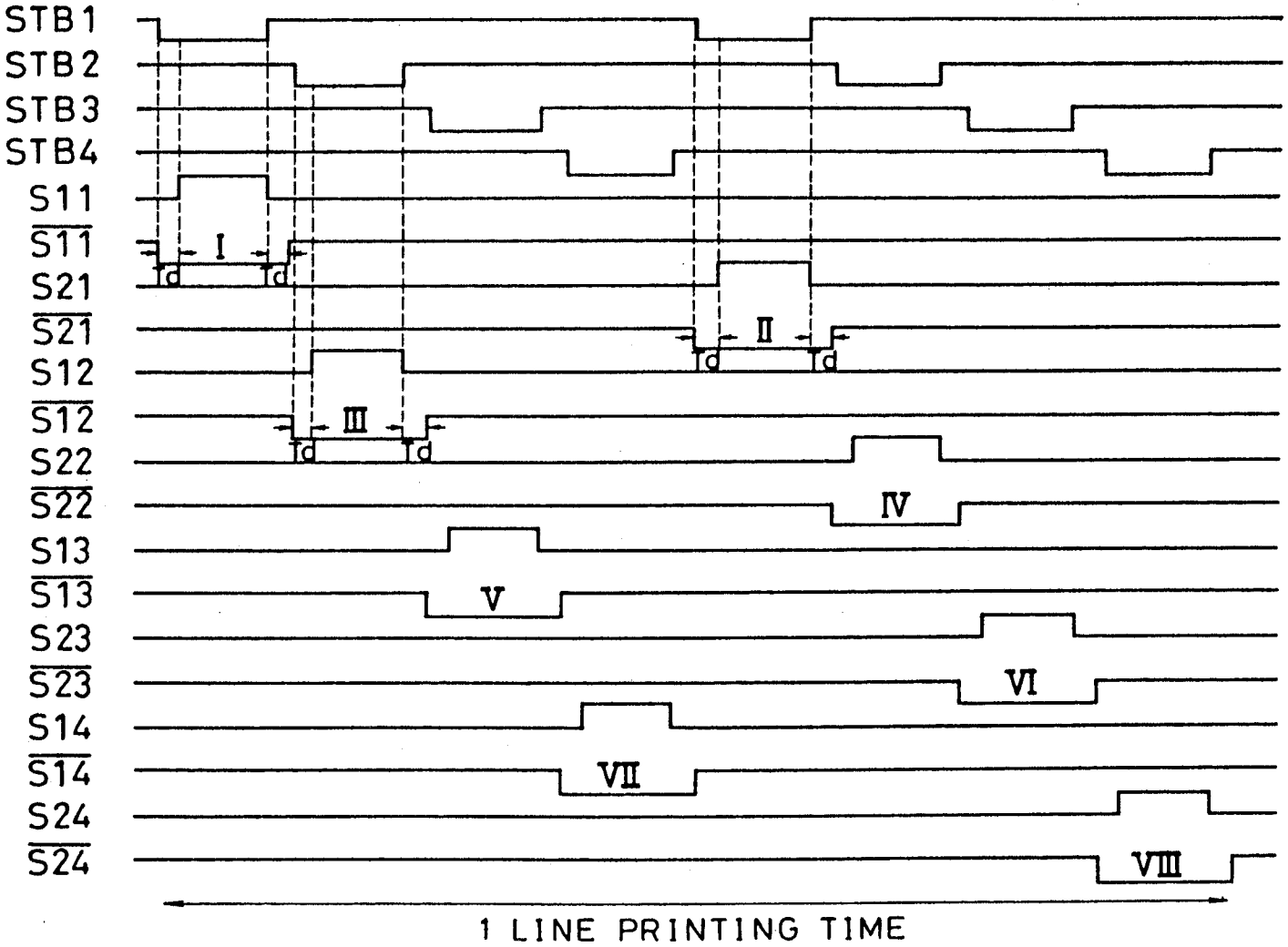
FIG. 16 is a timing chart illustrating the operation of the circuit of FIG. 15.

FIG. 16 illustrated a timing chart of the signal for driving the thermal head. In FIG. 16, signals S11 to $\overline{S21}$ are generated by the voltage level switching circuit a1, signals S12 to $\overline{S22}$ are generated by the circuit a2, signals $\overline{S13}$ to S23 are generated by the circuit a3 and signals S14 to $\overline{S24}$ are generated by the circuit a4.

Figure 17:
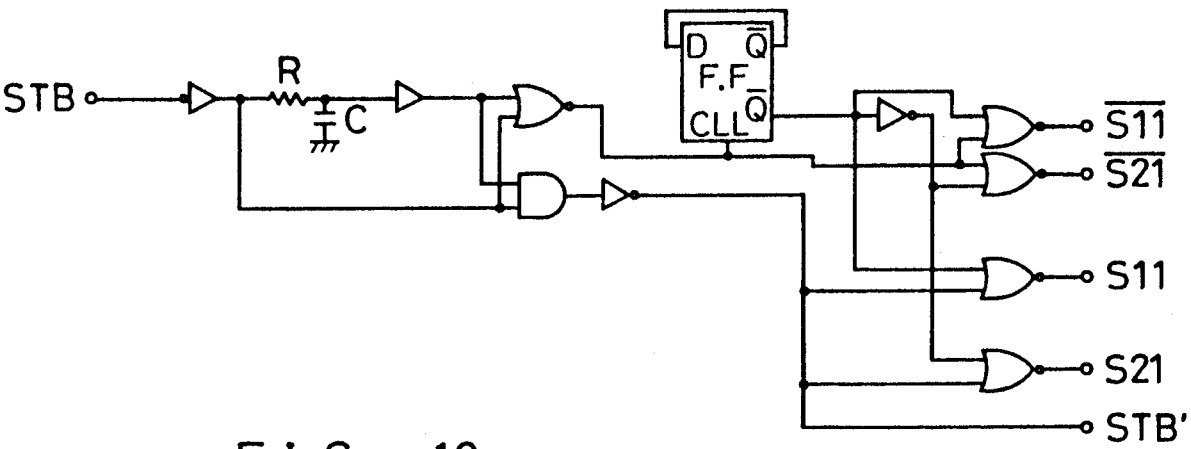

Although FIG. 17 illustrates the circuit a1, the circuits a2 to a4 are the same as the circuit a1.

Signals from the terminal STB are inputted to the voltage level switching circuit a1 as illustrated in FIG. 15. A resistance R and a capacitor C illustrated in FIG. 17 produce a period of time Td, provided in the signals S11 and $\overline{S11}$. The period of time is about 10$\mu$ sec. Signals as shown in FIG. 16 are obtained from the terminals S11 to $\overline{S21}$ in FIG. 17. The signals from the terminals are connected to the terminals corresponding to those in FIG. 18. Further voltage VH is applied to terminals of C1 and C2 in FIG. 18 during periods I and II shown in FIG. 16. The STB signal inputted to the driving IC is shorter than the signal inputted to the circuit a1 due to the resistance R and the capacitor C by the period Td.

Figure 19:
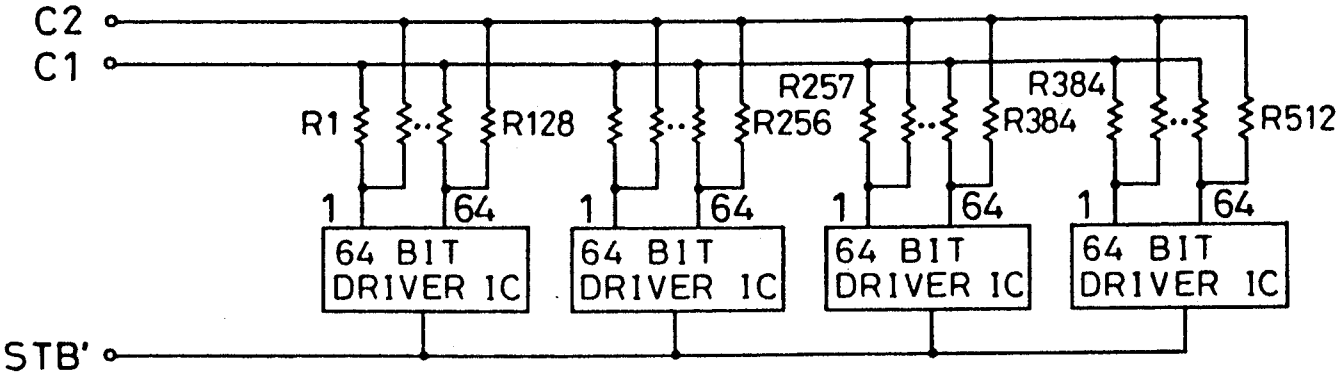

The driver unit B1 in FIG. 15 is composed of four 64-bit driver ICs as shown in FIG. 19 and is driven in response to a single signal STB'. The basic circuit is the same as that illustrated in FIG. 9. Signals CLOCK, LATCH, DATA and B.E.O are omitted in FIG. 19.

Figure 5:
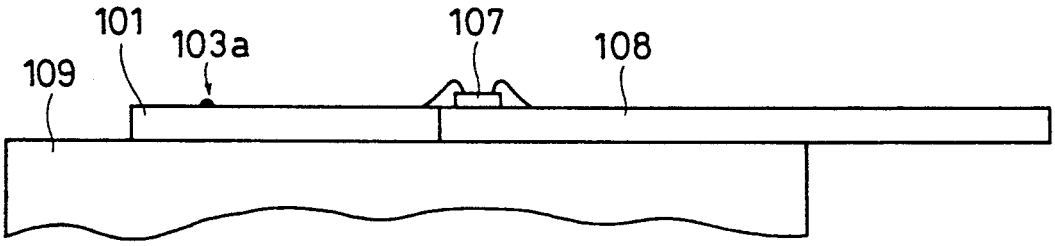
FIG. 5 (PRIOR ART)
FIGS. 5 to 7 are diagrams for illustrating a structure of the prior art embodiment.
Figure 6:
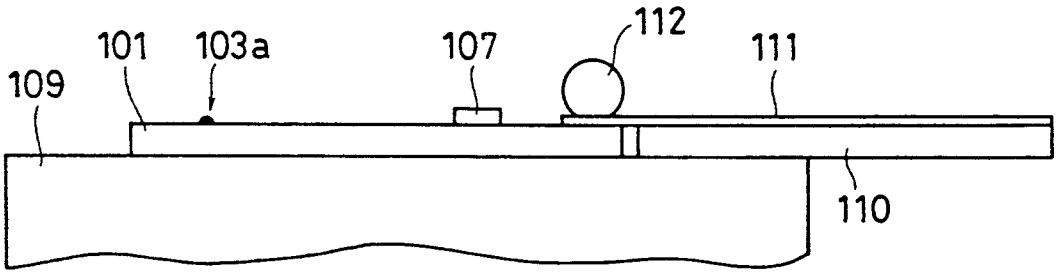
FIG. 6 (PRIOR ART)
Figure 7:
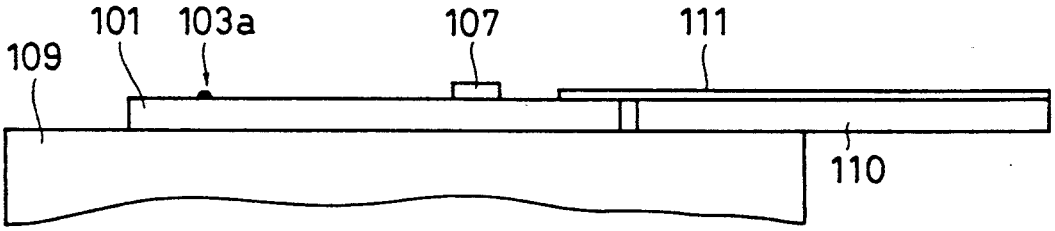
FIG. 7 (PRIOR ART)
Figure 20:
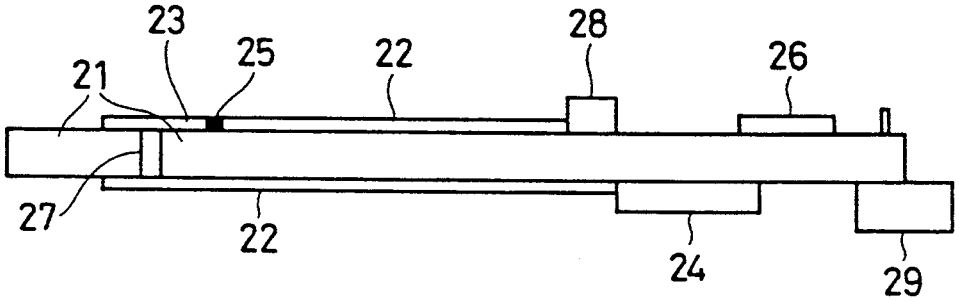
FIG. 20 is a diagram for illustrating a structure of the thermal head shown in FIG. 15.
Figure 21:
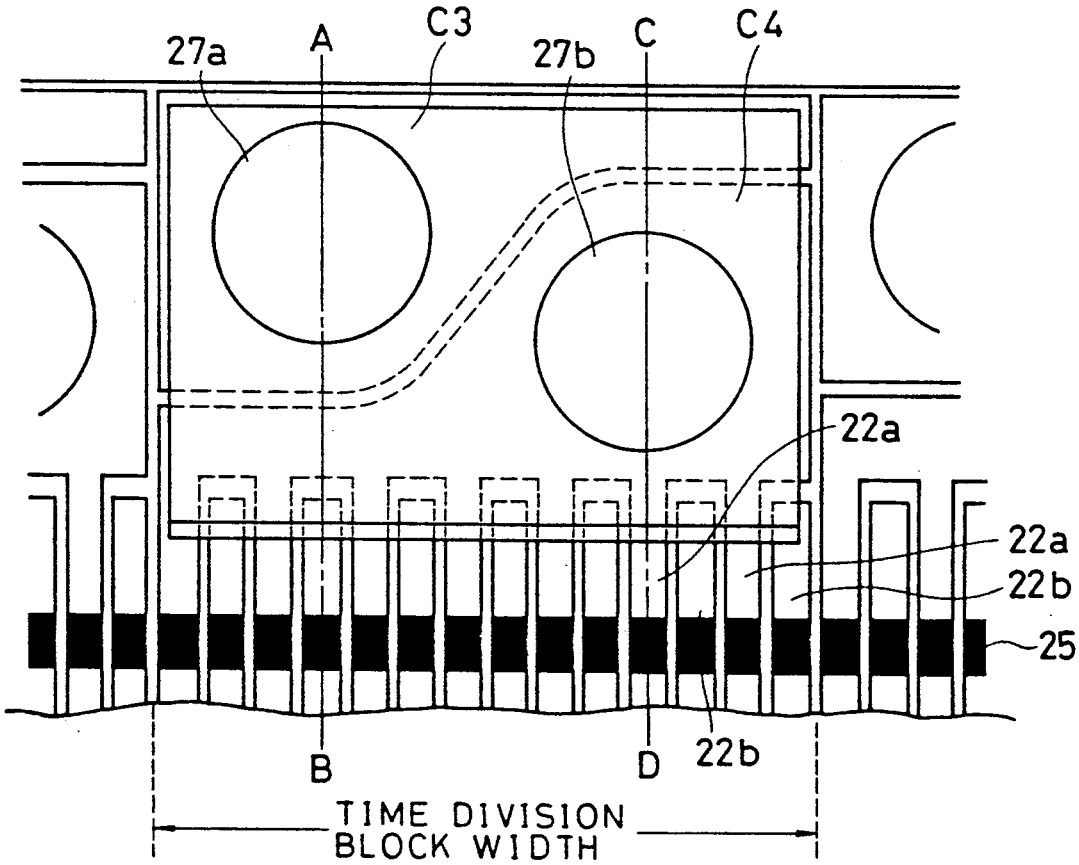
FIG. 21 is a plan view illustrating in detail a part of a common electrode of the thermal head shown in FIG. 20.
Figure 22:
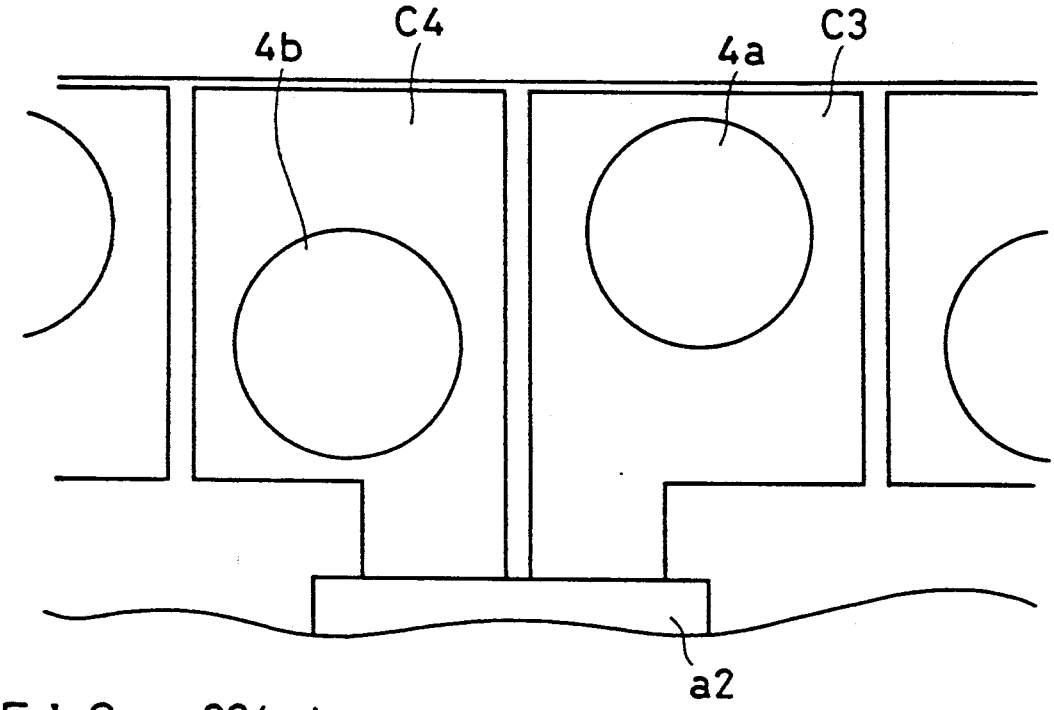
FIG. 22 illustrates is a bottom view of FIG. 21.

FIGS. 20 to 23 are diagrams illustrating a structure of a major portion of the termal head. FIG. 20 is a side view, FIG. 21 is a plan view of the major portion, FIG. 22 is a bottom view of the major portion, FIG. 23(*a*) is a sectional view along the line A—B of FIG. 21 and FIG. 23(*b*) is a sectional view along the line C—D of FIG. 21. First, in FIG. 20, the heating element array 25 (which corresponds to the heat generating elements R1 to R2048 in FIG. 15), a common electrode 23 (which corresponds to the common electrodes C1 to C8 in FIG. 15) and a discrete electrode 22 are formed on a heat resisting insulating substrate 21. A part of the discrete electrode 22 can be made on the bottom surface of the substrate through a through hole 27. A driver 28 (corresponding to the driver units B1 to B4 in FIG. 5) is electrically connected to the discrete electrode 22 by a face down bonding technique, for example, the common electrode 23 is wire on the bottom surface through another through hole and is electrically connected to a voltage level switching circuit 24 (which corresponds to the circuits a1 to a4 in FIG. 5). In addition to that, an electric part 26 and a connector 29 for externally connecting, which are required for the operation of the thermal head, are connected. Thus, the thermal head can be structured of a single heat resisting insulating substrate. As required, a board of metal or resin for radiating heat and reinforcing the device may be provided on the bottom surface.

FIG. 21 illustrates the common electrodes further in detail. In FIG. 21, the common electrodes C3, C4 are electrically connected to the bottom surface through holes 27*a*, 27*b*. Further, the common electrodes C3, C4 on the bottom surface in FIG. 22 are connected to the voltage level switching circuit a2.

Figure 23A:
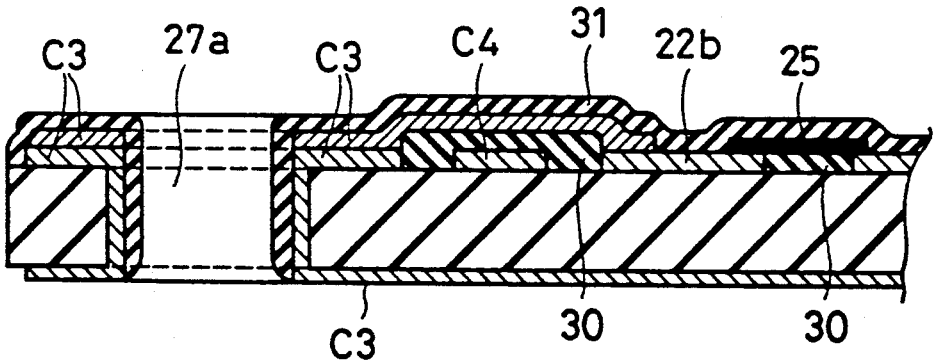
FIG. 23(*a*) illustrates is a sectional view along the line A—B of FIG. 21.
Figure 23B:
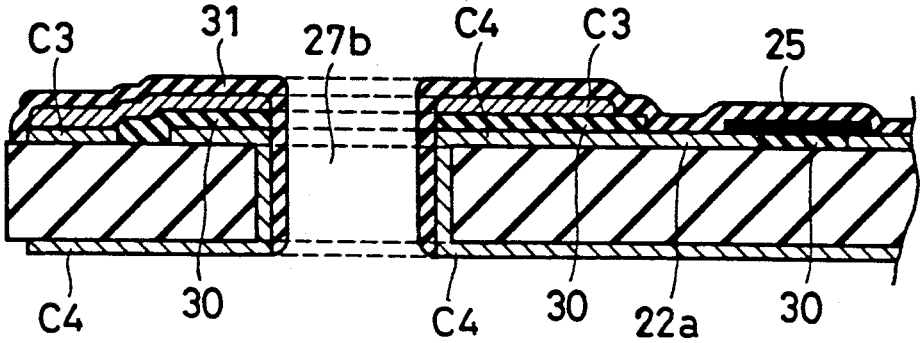

The manufacturing steps are the same as in the above description. As a substrate, a heat resisting insulating substrate provided with copper foil on its top and bottom surface in advance, is employed. After required through holes are formed, discrete electrodes, common electrodes and heat generating elements are formed by photo-etching technique. At this time, the common electrode C4 in FIG. 2 is connected to every other one of discrete electrodes 22*a*. Thereafter, the entire surface is coated with polyimide and cured. Then etching is carried out to a portion under the heat generating layer and the entire region corresponding to the common electrode C4, throughly, to form an insulating layer 30 having heat resistivity (FIG. 23). Then, the heat generating layer 25 is formed on the insulating layer 30. The region corresponding to the common electrode C3 and discrete electrodes 22*b* are electrically connected by depositing conductor such as aluminum by sputtering or vapor deposition. Thereafter, a protecting film 31 is formed on the surface by sputtering or the like.

With the process steps as stated above, the discrete electrodes from the heat generating elements R1 to R1024 can be connected to the common electrodes C1 to C8 as shown in FIG. 15. The two common electrodes are connected to the voltage switching circuits a1 to a4 on the bottom surface of the substrate. Hence, driving voltage is applied to the common electrodes in every time division block, in synchronization with the strobe signals.

As has been described, in this embodiment, even when the number of time divisions is increased, the wiring in the common electrodes are not so complicated. Utilization of the bottom surface of the substrate makes it possible to form common electrodes sufficiently large. Thus, voltage drop due to the common electrodes is very small. The thermal heat itself is compact as compared with the conventional embodiment.

When the whole of the thermal printing head should be driven with a two-divided drive method, time division block width in FIG. 21 can be extended to the end along the major scanning direction of the thermal printing head, and only one voltage level switching circuit is required. Thus, when an external circuit is substituted for the voltage level switching circuit or voltage is supplied to the thermal printing head by switching voltage on the side of an external power supply, the thermal printing head can be made small. Thus, cost can be decreased.

As will be recognized from the embodiments, using a heat resisting insulating substrate made of resin, a thermal printing head, in which a ceramic part and a substrate part are integrated, can be obtained. Additionally, because through holes and the like can be processed easily in the substrate, wiring between a heating element and a circuit driving it is simplified. Further the yield in production is improved. Accordingly, considerably cost-reduced and compact thermal heads can be obtained.

What is claimed is:

1. A thermal printing head, comprising:

an insulating substrate formed of a heat resisting cloth impregnated with a heat resisting resin;

a plurality of heating elements of an electrically resistive material linearly disposed on said substrate including 2n elements numbered from 1 to 2n in linear arrangement (n being a natural number);

a shield layer interposed between said plurality of heating elements and said insulating substrate for preventing said insulating substrate from exerting chemical influence on said plurality of heating elements;

conduction controlling means, mounted on said insulating substrate, for controlling electric conduction of said plurality of heating elements corresponding to printing of data;

a common electrode formed on said insulating substrate for commonly connecting an end of each of said plurality of heating elements, wherein said common electrode is separated into first and second common electrodes and;

a plurality of discrete electrodes formed on said substrate, said plurality of discrete electrodes for connecting the other end of each of said plurality of heating elements to said conduction controlling means; and a metal layer interposed between said plurality of heating elements and said plurality of discrete electrodes for connection in a ohmic contact, said plurality of heating elements being divided into a first block of heating elements numbered from 1 to n and a second block of heating elements numbered from n+1 to 2n, one end of each of said plurality of heating elements in the first block being connected to said first common electrode, and one end of each of said plurality of elements in the second block being connected to said second common electrode, a pair of the other ends of said elements numbered 1 and 2n, elements numbered 2 and 2,−1, . . . , elements numbered i and 2n+1−i (i being a natural number, 1<i<n . . . ), elements numbered n and n+1 being connected to said conduction controlling means.

2. The thermal printing head of claim 1, wherein said substrate further comprises plural voltage level switching means, said plurality of heating elements being divided into blocks corresponding to the number of said voltage level switching means, said common electrodes being separated on the basis of each of said blocks, and said separated common electrodes in each of said blocks further being separated into first and second common electrodes; and in each of said blocks, said first and second common electrodes being connected to one of said plural voltage level switching means for switching the voltage level at each of said common electrodes;

one end of each of said plurality of heating elements in odd number sequence being connected to said first common electrode, and one end of each of said plurality of heating elements in even number sequence being connected to said second common electrode; and a pair of the other ends of adjacent heating elements being connected to a common one of said conduction controlling means.

3. The thermal printing head of claim 1, wherein said common electrode includes electrodes provided on both sides of said substrate, said electrodes on both sides being electrically connected to each other through a through hole in said substrate.

4. The thermal printing head of claim 1, wherein said plurality of discrete electrodes includes electrodes provided on both sides of said substrate, said electrodes on both sides being electrically connected through a through hole in said substrate.

5. The thermal printing head of claim 1, wherein said substrate further comprises a connector for connecting an external circuit to said conduction controlling means.

6. A thermal printing apparatus comprising:

a heat resisting insulating substrate including a heat resisting cloth impregnated with a heat resisting resin and at least one through hole;

a plurality of heating elements linearly disposed above said heat resisting insulating substrate;

shield means, interposed between the heat resisting insulating substrate and the plurality of heating elements, for preventing the heat resisting insulating substrate from exerting chemical influence on the plurality of heating elements;

conduction control means, mounted on the heat insulating substrate and operatively connected to one end of each of the plurality of heating elements through a plurality of discrete electrodes, for controlling electric conduction of the plurality of heating elements so as to control printing of desired data; and common electrode means, formed above the heat resisting insulating substrate, for commonly connecting the other end of each of the plurality of heating elements, said common electrode means including a plurality of common electrodes, each of the plurality of common electrodes connecting the end of at least two of said plurality of heating elements.

7. The thermal head of claim 6 further comprising:

a metal layer, interposed between said plurality of heating elements, said common electrode means and discrete electrodes, for ohmic contact connection.

8. The thermal head of claim 6, wherein at least one of said plurality of common electrodes is formed below said heat resisting insulating substrate, said at least one common electrode being connected to one end of at least two of the plurality of heating elements through said at least one through hole.

9. The thermal head of claim 8, further comprising:

voltage level switching means, formed below said heat resisting insulating substrate and operatively connected to said common electrodes, for switching the voltage level of the plurality of common electrodes in accordance with the conduction control means.

10. The thermal head of claim 6, wherein said control conduction means includes a plurality of drivers, each of said plurality of drivers being connected to one end of at least two of the plurality of heating elements through a discrete electrode.

11. The thermal head of claim 10, wherein at least one of said plurality of discrete electrodes is formed above said heat resisting insulating substrate and at least one of said plurality of discrete electrodes is formed below said heat resisting insulating substrate and is connected to said conduction control means and at least two of said plurality of heating elements through a through hole in said substrate.

* * * * *